US008382445B2

(12) United States Patent
Roseberry

(10) Patent No.: US 8,382,445 B2
(45) **Date of Patent: *Feb. 26, 2013**

(54) AIR LOGIC CONTROLLER

(75) Inventor: David Roseberry, Mansfield, OH (US)

(73) Assignee: Warren Rupp, Inc., Mansfield, OH (US)

( * ) Notice: Subject to any disclaimer, the term of this patent is extended or adjusted under 35 U.S.C. 154(b) by 342 days.

This patent is subject to a terminal disclaimer.

(21) Appl. No.: 12/639,334

(22) Filed: Dec. 16, 2009

(65) Prior Publication Data

US 2011/0142692 A1 Jun. 16, 2011

(51) Int. Cl.
*F04B 49/00* (2006.01)

(52) U.S. Cl. ..... 417/46; 417/53; 417/385; 91/335; 91/264; 91/313

(58) Field of Classification Search ..... 417/46, 417/53, 385, 395; 91/335, 38, 40, 264, 313
See application file for complete search history.

(56) References Cited

U.S. PATENT DOCUMENTS 3,741,689 A 6/1973 Rupp
3,838,946 A 10/1974 Schall
3,860,034 A 1/1975 Rupp
4,381,180 A 4/1983 Sell
4,475,665 A 10/1984 Norton
4,478,560 A 10/1984 Rupp
4,549,467 A 10/1985 Wilden et al.
4,856,969 A * 8/1989 Forsythe et al. ..... 417/395
4,966,528 A 10/1990 Henkel et al.
5,174,731 A 12/1992 Korver
5,252,041 A 10/1993 Schumack
5,257,914 A 11/1993 Reynolds
5,326,234 A 7/1994 Versaw et al.
5,332,372 A 7/1994 Reynolds
5,334,003 A 8/1994 Gardner et al.
5,567,477 A 10/1996 Snyder, Jr.
5,620,746 A 4/1997 Snyder, Jr.
5,816,778 A * 10/1998 Elsey et al. ..... 417/46
5,839,883 A 11/1998 Schmidt et al.
5,996,627 A 12/1999 Reynolds
6,036,445 A 3/2000 Reynolds
6,099,264 A 8/2000 Du
6,126,403 A 10/2000 Yamada
6,129,525 A 10/2000 Reynolds
6,132,176 A 10/2000 Higgins
(Continued)

FOREIGN PATENT DOCUMENTS

WO PCTUS2005041512 2/2005

*Primary Examiner* — Charles Freay
*Assistant Examiner* — Ryan Gatzemeyer
(74) *Attorney, Agent, or Firm* — Brouse McDowell; Heather M. Barnes

(57) ABSTRACT

An air logic controller for increasing the efficiency of an air operated double diaphragm pump. The air logic controller may increase the efficiency of the pump by controlling the supply of compressed fluid to the pump. In one embodiment, the air logic controller may control the supply of compressed fluid to the pump by replacing the continuous, large volume supply of compressed fluid supplied to conventional air operated pumps during a single pumping stroke with a varied supply of compressed fluid. The varied supply of compressed fluid may comprise a supply of compressed fluid that alternates between a large volume supply and a small volume supply of compressed fluid. The air logic controller may vary the supply of compressed fluid to the pump based at least partially on the position of a main air valve spool and the setting on an adjustable pneumatic time delay relay.

17 Claims, 4 Drawing Sheets

U.S. PATENT DOCUMENTS

| | | | | |
|---|---|---|---|---|
| 6,168,387 | B1 | 1/2001 | Able et al. | |
| 6,241,487 | B1 | 6/2001 | Reynolds | |
| 6,273,686 | B1 | 8/2001 | Kroell et al. | |
| 6,280,149 | B1 | 8/2001 | Able et al. | |
| 6,554,578 | B1 | 4/2003 | Siegel | |
| RE38,239 | E | 8/2003 | Duncan | |
| 6,874,997 | B2 | 4/2005 | Watanabe et al. | |
| 7,021,909 | B1 | 4/2006 | Steck | |
| 7,360,999 | B2 | 4/2008 | Nelson et al. | |
| 7,517,199 | B2 | 4/2009 | Reed et al. | |
| 7,658,598 | B2 | 2/2010 | Reed et al. | |
| 2006/0104829 | A1 | 5/2006 | Reed et al. | |
| 2006/0159565 | A1 * | 7/2006 | Sanwald | 417/395 |
| 2007/0092386 | A1 | 4/2007 | Reed et al. | |
| 2007/0126416 | A1 | 6/2007 | Zhu et al. | |
| 2007/0248474 | A1 | 10/2007 | Dietzsch et al. | |
| 2010/0189577 | A1 * | 7/2010 | McCourt et al. | 417/293 |

* cited by examiner

1

AIR LOGIC CONTROLLER

I. BACKGROUND

A. Field of Invention

This invention pertains to the art of methods and apparatuses of diaphragm pumps and more specifically to the art of methods and apparatuses of control devices for increasing the efficiency of an air operated diaphragm pump.

B. Description of the Related Art

Fluid-operated pumps, such as diaphragm pumps, are widely used particularly for pumping liquids, solutions, viscous materials, slurries, suspensions or flowable solids. Double diaphragm pumps are well known for their utility in pumping viscous or solids-laden liquids, as well as for pumping plain water or other liquids, and high or low viscosity solutions based on such liquids. Accordingly, such double diaphragm pumps have found extensive use in pumping out sumps, shafts, and pits, and generally in handling a great variety of slurries, sludges, and waste-laden liquids. Fluid driven diaphragm pumps offer certain further advantages in convenience, effectiveness, portability, and safety. Double diaphragm pumps are rugged and compact and, to gain maximum flexibility, are often served by a single intake line and deliver liquid through a short manifold to a single discharge line.

Although known diaphragm pumps work well for their intended purpose, several disadvantages exist. Air operated double diaphragm (AODD) pumps are very inefficient when compared to motor driven pumps. This is due, in large part, to the compressibility of the air or fluid used to drive the pump and the inefficiency of compressed air systems generally. AODD pumps normally operate at a lower overall efficiency than centrifugal and other rotary pumps.

What is needed then is a double diaphragm pump that provides an increased amount of efficiency.

II. SUMMARY

According to one embodiment of the invention, a pump may comprise a first chamber housing, a second chamber housing, an air distribution system, and an air logic controller. The first chamber housing may comprise a first pumping chamber and a first fluid chamber. The first pumping chamber and the first fluid chamber may be separated by a first diaphragm. The second pumping chamber and the second fluid chamber may be separated by a second diaphragm. The first diaphragm and the second diaphragm may be operatively connected to a connecting rod that enables the first and second diaphragms to move in a reciprocal manner. The air distribution system may alternately supply a compressed fluid to the first and second fluid chambers to cause a pumped fluid to be pumped through the first and second pumping chambers. The air logic controller may be operatively connected to a center section of the pump and may control the supply of the compressed fluid into the pump. The air logic controller may comprise an input valve assembly; a flow restrictor; and, a first time delay relay. Upon receiving a first signal from the air distribution system, the first time delay relay may transmit the second signal to the input valve assembly to cause a first volume of the compressed fluid to be supplied to the pump for a first amount of time. The transmission of the first signal may be at least partially caused by the reciprocal movement of the first and second diaphragms. Upon expiration of the first amount of time the input valve assembly may cause a second volume of compressed fluid to be supplied to the pump. The second volume of compressed fluid may be less than the first volume of compressed fluid.

One advantage of this invention is the reduction in air consumption during the operation of an air operated double diaphragm pump particularly at low discharge pressures.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DETAILED DESCRIPTION

Figure 1:
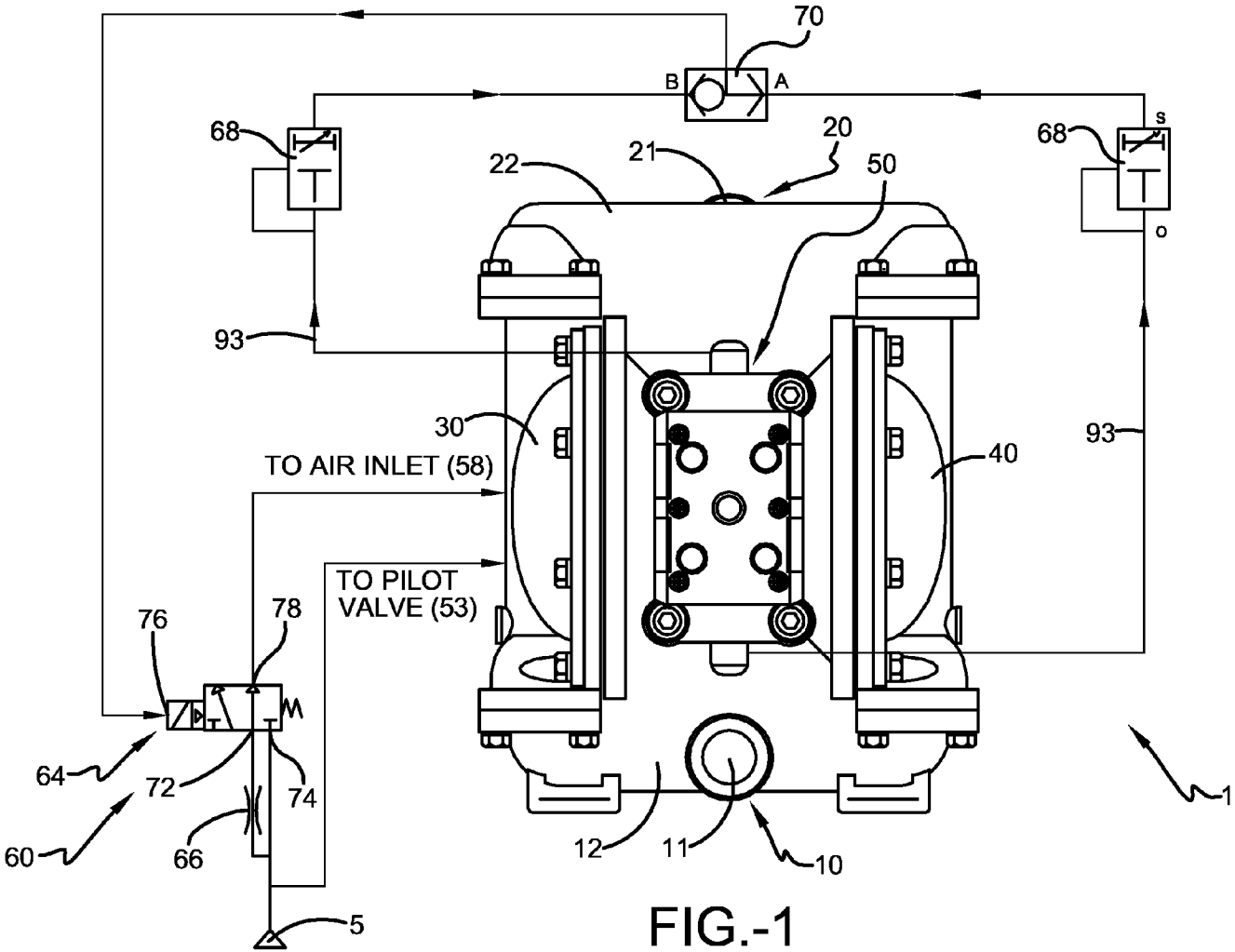
FIG. 1 shows a schematic view of an air logic controller operatively coupled to an air operated double diaphragm pump according to one embodiment of the invention.

Referring now to the drawings wherein the showings are for purposes of illustrating embodiments of the invention only and not for purposes of limiting the same, FIG. 1 shows an air operated double diaphragm pump 1 comprising an air logic controller 60 according to one embodiment of the invention. The air logic controller 60 may increase the efficiency of the pump 1 by controlling or optimizing the amount of a motive fluid such as compressed air supplied to the pump 1. In one embodiment, the air logic controller 60 may control the amount of compressed air supplied to the pump 1 by replacing the continuous, large volume supply of compressed air supplied to conventional air operated pumps with a varied supply of compressed air. The varied supply of compressed air may comprise a supply of compressed air that alternates between a large and small volume supply. The terms "motive fluid," "compressed fluid," "compressed air," "fluid," and "air" as used herein may be used interchangeably and may refer to a source of pressurized or compressed fluid, commonly air, supplied to the pump 1 for operating the pump 1 as is well known in the art.

With reference now to FIG. 1, the pump 1 may comprise an inlet manifold 10, an outlet manifold 20, a first chamber housing 30, a second chamber housing 40, and a center section 50. The inlet manifold 10 may comprise an inlet 11, a pumped fluid passage 12, and an inlet control valve assembly, not shown. Pumped fluid may enter or be suctioned into the pump 1 through the inlet 11. The inlet control valve assembly, not shown, may at least partially control the flow of pumped fluid into the pump 1. In one embodiment, the inlet control valve assembly, not shown, may comprise a pair of inlet check valves, such as, for one non-limiting example, a pair of ball-type check valves, positioned to control the flow of pumped fluid through the pumped fluid passage 12 and into the first and second chamber housings 30, 40 as is well known in the art. The outlet manifold 20 may comprise an outlet 21, a pumped fluid passage 22, and an outlet control valve assembly, not shown. The outlet control valve assembly, not shown, may at least partially control the flow of pumped fluid exiting the pump 1. In one embodiment, the outlet control valve assembly, not shown, may comprise a pair of outlet check valves, such as, for one non-limiting example, a pair of ball-type check valves, positioned to control the flow of pumped fluid from the first and second chamber housings 30, 40 and into the pumped fluid passage 22 wherein it can be exhausted from the pump via the outlet 21.

Figure 2:
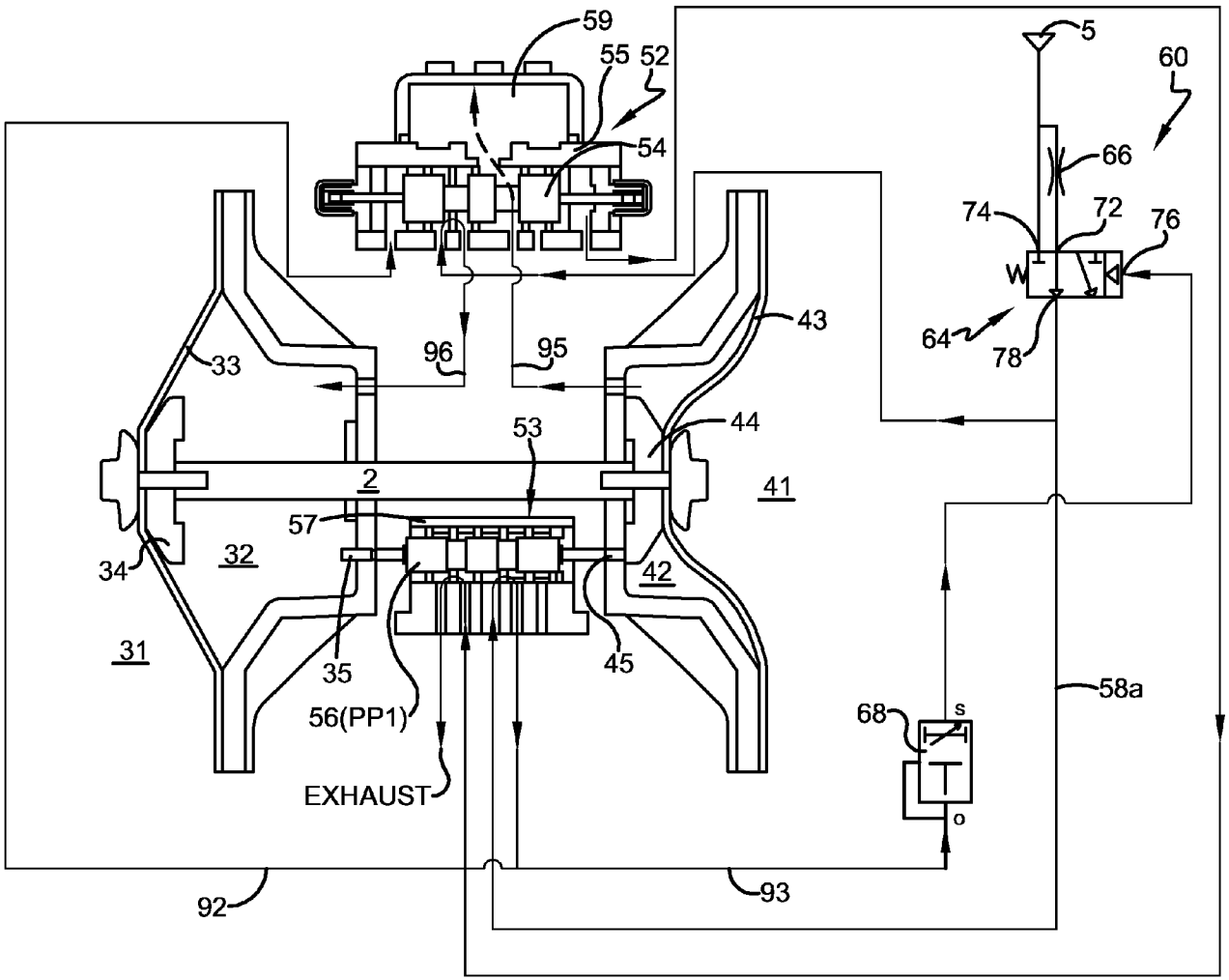
FIG. 2 shows a schematic view of an air operated double diaphragm pump having an air logic controller wherein the air operated double diaphragm pump comprises a left position according to one embodiment of the invention.

With reference now to FIGS. 1 and 2, the first and second chamber housings 30, 40 may each comprise a pumping chamber 31, 41 and a fluid chamber 32, 42 separated by a diaphragm 33, 43 spanning the width of the chamber housing 30, 40. The pumping chambers 31, 41 may be in fluid communication with the pumped fluid passages 12, 22. The inlet control valve assembly, not shown, may be positioned to control the flow of pumped fluid entering the first and second pumping chambers 31, 41 via the pumped fluid passage 12. The outlet control valve assembly, not shown, may be positioned to control the flow of pumped fluid exiting the first and second pumping chambers 31, 41 into the pumped fluid passage 22. The diaphragms 33, 43 may comprise a relatively flexible membrane having an outer peripheral portion that is fixedly attached to the first and second chamber housings 30, 40, respectively. First and second connecting plates 34, 44 may operatively connect the center portion of the diaphragms 33, 43 to a connecting rod 2. The connecting rod 2 may extend through the center section 50 and may enable the diaphragms 33, 43 to be displaced or moved in a reciprocating manner to pump or urge pumped fluid through the pump 1 as is well known in the art.

With continuing reference to FIGS. 1 and 2, in one embodiment, compressed fluid may be directed into the fluid chamber 32 thereby causing the diaphragms 33, 43 to be moved towards an extreme left position, shown in FIG. 2. Compressed fluid entering the fluid chamber 32 may apply pressure against the diaphragm 33. The applied pressure may flex the diaphragm 33 outward or to the left, away from the center section 50. As the pressure applied to the diaphragm 33 moves the diaphragm 33 to the left, the diaphragm 43 is pulled to the left or inward, towards the center section 50, via the connecting rod 2. The outward movement of the diaphragm 33 may cause pumped fluid located within the pumping chamber 31 to be discharged from the pump 1 via the outlet 21 as the inlet control valve assembly, not shown, simultaneously prevents pumped fluid from being drawn or suctioned into the pumping chamber 31 via the inlet manifold 10. The inward movement of the diaphragm 43 may cause compressed air located within the fluid chamber 42 to be discharged or exhausted and may cause pumped fluid to be drawn or suctioned into the pumping chamber 41 via the inlet manifold 10. As pumped fluid is drawn into the pumping chamber 41, the outlet control valve assembly, not shown, may prevent the pumped fluid entering the pumping chamber 41 from exiting the pump 1 via the outlet manifold 20.

Figure 3:
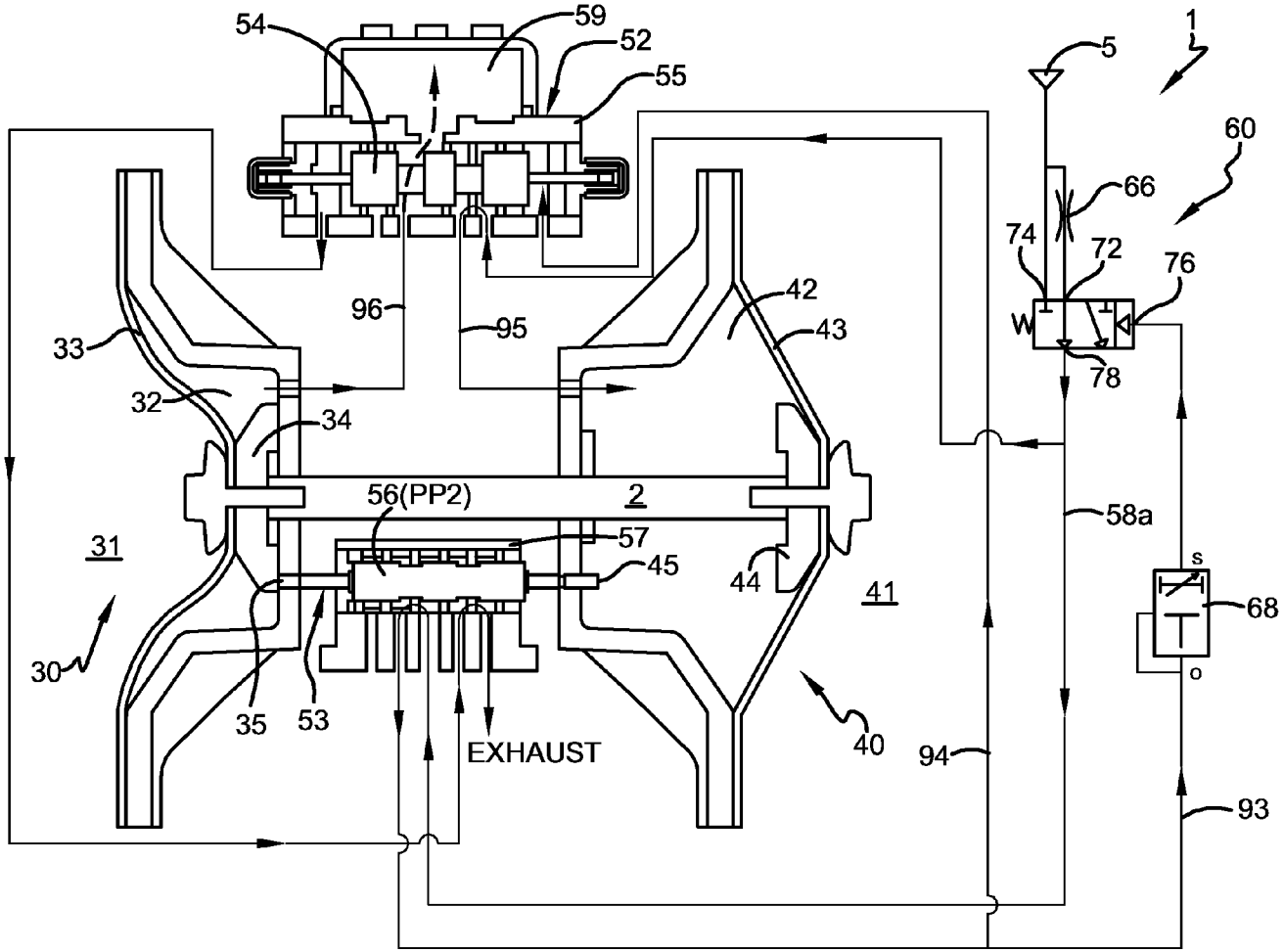
FIG. 3 shows a schematic view of an air operated double diaphragm pump having an air logic controller wherein the air operated double diaphragm pump comprises a right position according to one embodiment of the invention.

With reference now to FIGS. 1 and 3, upon reaching the extreme left position, compressed air may be supplied to the fluid chamber 42 while being exhausted from the fluid chamber 32. Compressed fluid entering the fluid chamber 42 may apply pressure against the diaphragm 43. The applied pressure may flex the diaphragm 43 outward or to the right, away from the center section 50. As the pressure applied to the diaphragm 43 moves the diaphragm 43 to the right, the diaphragm 33 is pulled to the right or inward, towards the center section 50, via the connecting rod 2. The outward movement of the diaphragm 43 may cause pumped fluid located within the pumping chamber 41 to be discharged from the pump 1 via the outlet 21 as the inlet control valve assembly, not shown, simultaneously prevents pumped fluid from being drawn or suctioned into the pumping chamber 41 via the inlet manifold 10. The inward movement of the diaphragm 33 may cause compressed air located within the fluid chamber 32 to be discharged or exhausted and may cause pumped fluid to be drawn or suctioned into the pumping chamber 31 via the inlet manifold 10. As pumped fluid is drawn into the pumping chamber 31, the outlet control valve assembly, not shown, may prevent the pumped fluid entering the pumping chamber 31 from exiting the pump 1 via the outlet manifold 20.

With reference now to FIGS. 1, 2, and 3, the alternate pressuring and exhausting of the fluid chambers 32, 42 may generally be controlled by an air distribution system as is well known in the art. The air distribution system may be operatively connected to the center section 50 of the pump 1 between the first and second chamber housings 30, 40. In one embodiment, the air distribution system may be positioned substantially within the center section 50. In one embodiment, the air distribution system may comprise a pilot operated, four-way spool type air distribution valve having a main air valve assembly 52 and a pilot valve assembly 53. The main air valve assembly 52 may comprise a main air spool valve 54 and a main air valve body 55. The main air spool valve 54 may be slidably positioned within the main air valve body 55. The movement of the main air spool valve 54 to one end of the main air valve body 55 may cause compressed fluid to be directed into the fluid chamber 32 and exhausted from the fluid chamber 42 through an air exhaust 59. The movement of the main air spool valve 54 to the opposite end of the main air valve body 55 may cause the porting to be reversed such that compressed fluid is directed into the fluid chamber 42 and exhausted from the fluid chamber 32 through the air exhaust 59.

With reference now to FIGS. 2 and 3, in one embodiment, the movement or shifting of the main air spool valve 54 within the main air valve body 55 may be at least partially controlled by the pilot valve assembly 53. The pilot valve assembly 53 may comprise a pilot spool valve 56 and a pilot valve body 57. The pilot spool valve 56 may be slidably positioned within the pilot valve body 57. The pilot spool valve 56 may move between opposite ends of the pilot valve body 57 to alternately pressurize one end of the main air spool valve 54 by directing compressed fluid to one side of the main air valve body 55 while exhausting compressed fluid from the other side. The movement of the diaphragms 33, 34 may cause the movement of the pilot spool valve 56 within the pilot valve body 57. In one embodiment, the movement of the diaphragms 33, 43 to the left may cause at least a portion of the connecting plate 44 to contact a right actuator pin 45. The right actuator pin 45 may be operatively connected to the pilot spool valve 56 such that the contacting of the right actuator pin 45 by at least a portion of the connecting plate 44 causes the right actuator pin 45 to contact and move the pilot spool valve 56 to the left. The movement of the pilot spool valve 56 to the left, may cause compressed fluid to be directed to the left side of the main air valve body 55 such that the main air spool valve 54 is caused to move to the right. The movement of the main air spool valve 54 to the right may initiate the movement of the diaphragms 33, 43 to the right by causing compressed fluid to be directed into the fluid chamber 42 and exhausted from the fluid chamber 32. The movement of the diaphragms 33, 43 to the right may cause at least a portion of the connecting plate 34 to contact a left actuator pin 35. The left actuator pin 35 may be operatively connected to the pilot spool valve 56 such that the contacting of the left actuator pin 45 by at least a portion of the connecting plate 34 causes the left actuator pin 35 to contact and move the pilot spool valve 56 to the right. The movement of the pilot spool valve 56 to the right, may cause compressed fluid to be directed to the right side of the main air valve body 55 such that the main air spool valve 54 is caused to move to the left. The movement of the main air spool valve 54 to the left may initiate the movement of the diaphragms 33, 43 to the left by causing compressed fluid to be directed into the fluid chamber 32 and exhausted from the fluid chamber 42 as the process repeats.

With continued reference now to FIGS. 1-3, the air logic controller 60 may be operatively connected to the center section 50 and may comprise an input valve assembly 64, a flow restrictor 66, and a time delay relay 68. In one embodiment, the air logic controller 60 may comprise a housing, not shown. The air logic controller 60 may be substantially positioned within the housing, not shown, and the housing may be selectively attachable to the center section 50. The housing, not shown, may allow for the retro-fitting of a conventional pump with the air logic controller 60. Additionally, the housing, not shown, may allow for the selective detachment of the air logic controller 60 thereby facilitating the replacement, repair, and/or removal of the air logic controller 60. In another embodiment, the air logic controller 60 may be integral to the pump 1 and may be positioned substantially within the center section 50.

With continued reference now to FIGS. 1-3, the input valve assembly 64 may comprise a multi-position valve suitable for controlling the volume of compressed fluid directed to an air inlet 58, illustrated in FIGS. 2 and 3 by line 58*a*. In one embodiment, the input valve assembly 64 may comprise a 3-way/2-position (3/2) poppet valve having a first valve inlet 72, a second valve inlet 74, an actuation inlet 76, and a valve outlet 78. The input valve assembly 64 may comprise a normal position and an actuated position. The normal position may comprise a valve position wherein the first valve inlet 72 is in fluid communication with the valve outlet 78 and compressed fluid is blocked or prevented from flowing through the second valve inlet 74. The actuated position may comprise a valve position wherein the second valve inlet 74 is in fluid communication with the valve outlet 78 and compressed fluid is blocked or prevented from flowing through the first valve inlet 72. Compressed fluid directed to and flowing through the actuation inlet 76 may cause the input valve assembly 64 to be actuated or moved from the normal position to the actuated position as is well known in the art. In one embodiment, the input valve assembly 64 may comprise a 3-way/2-position poppet valve. The input valve assembly 64 may comprise any type of valve assembly suitable for selectively controlling the volume of compressed fluid directed to the air inlet 58 chosen with sound judgment by a person of ordinary skill in the art. The first valve inlet 72 may be in fluid communication with the flow restrictor 66 that is in fluid communication with a fluid supply source 5. The second valve inlet 74 may be in fluid communication with the fluid supply source 5. The flow restrictor 66 may be positioned between the fluid supply source 5 and the input valve assembly 64 such that a restricted or reduced flow of compressed fluid to be directed to the input valve assembly 64 such that the volume of compressed fluid directed to the pump 1 via the first valve inlet 72 is less than the volume of compressed fluid directed to the pump 1 via the second valve inlet 74. In one embodiment, the flow restrictor 66 may comprise a fixed flow restrictor that substantially uniformly restricts or reduces the flow of compressed fluid to a substantially constant volume. In another embodiment, the flow restrictor 66 may comprise an adjustable flow restrictor that may be manually adjusted by an associated user and/or automatically adjusted based at least partially on operating characteristics of the pump 1, such as for example, the velocity of the diaphragms 33, 43 or the volume of pumped fluid being suctioned into and/or discharged from the pump 1, chosen with sound judgment by a person of ordinary skill in the art.

Figure 4:
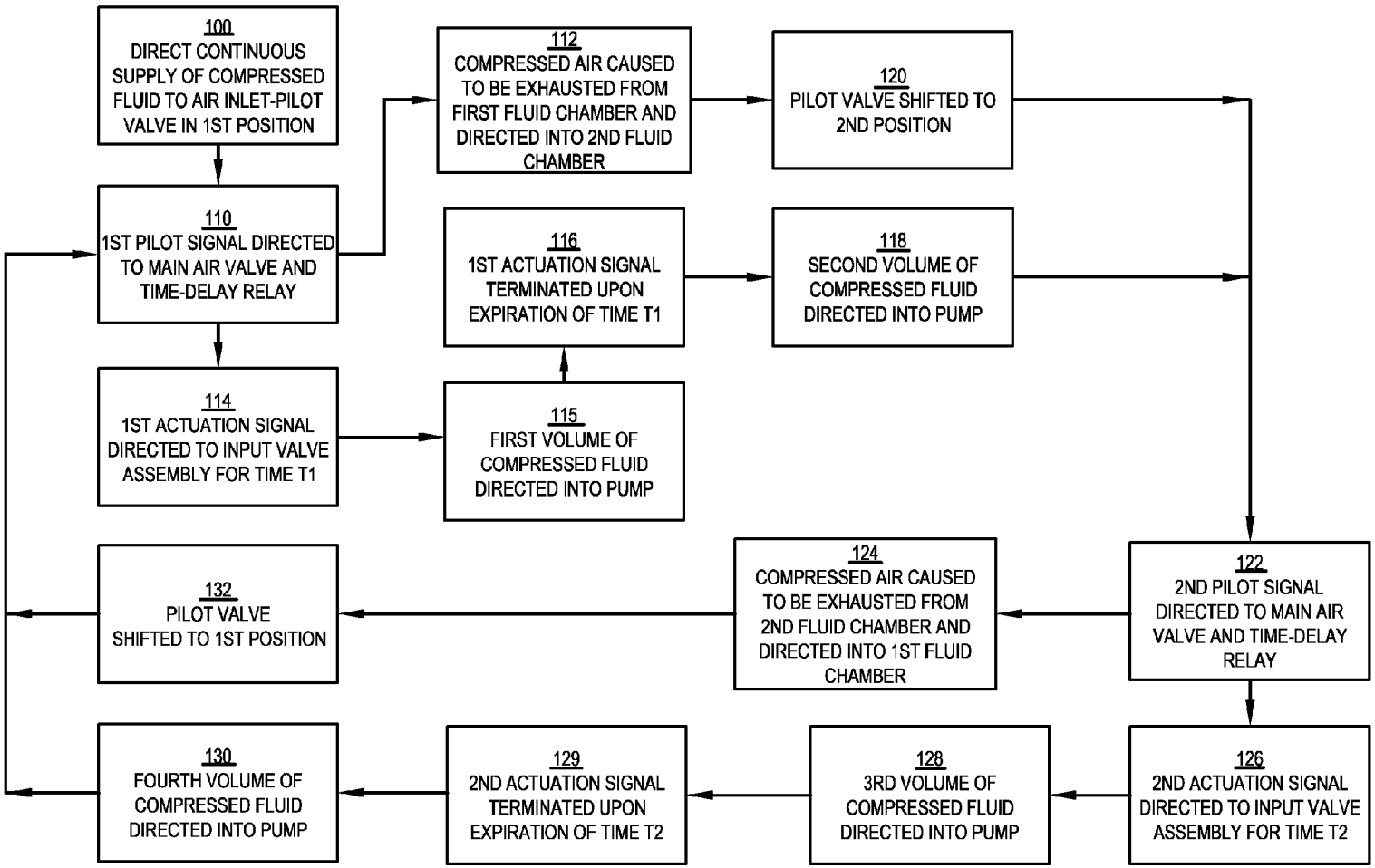
FIG. 4 shows a flowchart illustrating a method of operating an air operated double diaphragm pump having an air logic controller according to one embodiment of the invention.

With reference now to FIGS. 2, 3 and 4, in one embodiment, at least initially, to begin operation of the pump 1, the air logic controller 60 may at least partially cause a continuous supply of compressed fluid to be directed through the air inlet 58 to the pilot valve assembly 53 via line 58*a*, step 100. For purposes of describing the present invention only, the initial supply of compressed fluid directed to the air inlet 58 is described as causing the pilot spool valve 56 to be moved to the left end of the pilot valve body 57 or in a first pilot position PP1, shown in FIG. 2. In the first pilot position PP1 the pilot spool valve 56 may cause a first pilot signal PS1, via line 92, to be directed to the main air valve assembly 52 and to the time-delay relay 68, via line 93, shown in FIG. 2, step 110. The first pilot signal PS1 may cause the main air spool valve 54 to be moved to the right end of the main air valve body 55, thereby allowing compressed fluid to be exhausted from the fluid chamber 32, via line 96, and directed into the fluid chamber 42, via line 95, shown in FIG. 3, step 112.

With continuing reference to FIGS. 2, 3, and 4, the first pilot signal PS1 may cause the time delay relay 68 to direct a first actuation signal AS1 to the actuation inlet 76 of the input valve assembly 64 for a first predetermined amount of time T1, step 114. The first actuation signal AS1 may cause the input valve assembly 64 to move from the normal position to the actuated position thereby causing the first volume V1 of compressed fluid to be directed into the pump 1 via air inlet 58, step 115. Upon expiration of the first predetermined amount of time T1, the time delay relay 68 may terminate or stop directing the first actuation signal AS1 to the actuation inlet 76, step 116. The termination of the first actuation AS1 signal may cause the input valve assembly 64 to move from the actuated position to the normal position. The return of the input valve assembly 64 to the normal position may cause the second volume V2 of compressed fluid to be directed into the pump 1 via the air inlet 58, step 118. In one embodiment, the second volume V2 of compressed fluid may be directed into the pump 1 for substantially the remainder of the pumping stroke.

With continuing reference to FIGS. 2, 3, and 4, the movement of the diaphragms 33, 43 to the right may cause at least a portion of the connecting plate 34 to contact the left actuator pin 35 thereby causing the pilot spool valve 56 to move to the right end of the pilot valve body 57 or into a second pilot position PP2, step 120. The movement of the pilot spool valve 56 to the right may cause a second pilot signal PS2 to be directed to the main air valve assembly 52, via line 94, and to the time delay relay 68, shown in FIG. 3, step 122. In one embodiment, the second pilot signal PS2 may be directed to the time delay relay 68, via line 93. The second pilot signal PS2 may cause the main air spool valve 54 to move to the left side of the main air valve body 55. The movement of the main air spool valve 54 to the left may cause the porting to be reversed such that compressed fluid is exhausted from the fluid chamber 42, via line 95, and supplied to the fluid chamber 32, via line 96, shown in FIG. 2, step 124. The second pilot signal PS2 may cause the time delay relay 68 to direct a second actuation signal AS2 to the actuation inlet 76 of the input valve assembly 64 for a second predetermine amount of time T2, step 126. In one embodiment, the second predetermined amount of time T2 may be substantially equal to the first predetermined amount of time T1. In another embodiment, the time delay relay 68 may comprise an adjustable time delay relay 68 and the second predetermined amount of time T2 may be different than the first predetermined amount of time T1. The adjustable time delay relay 68 may be manually adjusted by an associated user and/or may be automatically adjusted based at least partially on one or more operating characteristics of the pump 1, such as, for example, the velocity of the diaphragms 33, 43; the rate at which pumped fluid is suctioned and/or discharged from the pump 1; or, any other operating characteristic of the pump 1 chosen with sound judgment by a person of ordinary skill in the art.

With continuing reference now to FIGS. 2, 3, and 4, the second actuation signal AS2 may cause the input valve assembly 64 to comprise the actuated position thereby causing a third volume V3 of compressed fluid to be directed to the pump 1 via the air inlet 58, step 128. Upon expiration of the second predetermined amount of time T2, the time delay relay 68 may terminate or stop directing the second actuation signal AS2 to the actuation inlet 76, step 129. The termination of the second actuation signal AS2 may cause the input valve assembly 64 to move from the actuated position to the normal position. The movement of the input valve assembly 64 to the normal position may cause a fourth volume V4 of compressed fluid to be directed into the pump 1 via the air inlet 58, step 130. In one embodiment, the fourth volume V4 of compressed fluid may be directed into the pump 1 for substantially the remainder of the pumping stroke. The third volume V3 and/or fourth volume V4 may comprise substantially the same volumes as the first volume V1 and the second volume V2, respectively. In another embodiment, the third volume V3 and the fourth volume V4 may comprise different volumes than the first volume V1 and the second volume V2, respectively. The movement of the diaphragms 33, 43 to the left may cause at least a portion of the connecting plate 44 to contact the right actuator pin 45 thereby causing the pilot spool valve 56 to move to the left end of the pilot valve body 57 thereby returning to the first pilot position PP1, step 132. The method may then repeat, or return to step 110.

With reference now to FIG. 1, in one embodiment, the air logic controller 60 may further comprise a second time delay relay 68 and an air logic or-element 70. In this embodiment, the second pilot signal PS2 may be directed to the second time delay relay 68. The air logic or-element 70 may be positioned between the first and second time delay relays 68. The first and second time delay relays 68 may direct the first and second actuation signals AS1, AS2, respectively, to the air logic-or element 70. The air logic or-element 70 may at least partially control the transmission of the first and second actuation signals AS1, AS2 to the input air valve assembly 64. In one embodiment, the air logic or-element 70 may prevent the transmission of one (first or second) actuation signal during the transmission of the other (second or first) actuation signal to the input air valve assembly 64, thereby at least partially ensuring that the volume of compressed fluid supplied to the pump 10 alternates between the first and second volumes V1, V2 and/or third and fourth volumes V3, V4 of compressed fluid.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A pump comprising:

a first chamber housing comprising:

a first pumping chamber and a first fluid chamber, wherein the first pumping chamber and the first fluid chamber are separated by a first diaphragm;

a second chamber housing comprising:

a second pumping chamber and a second fluid chamber, wherein the second pumping chamber and the second fluid chamber are separated by a second diaphragm, wherein the first diaphragm and the second diaphragm are operatively connected to a connecting rod that enables the first and second diaphragms to move in a reciprocal manner;

an air distribution system for alternately supplying a compressed fluid to the first and second fluid chambers to cause a pumped fluid to be pumped through the first and second pumping chambers; and, an air logic controller operatively connected to a center section of the pump for controlling the supply of the compressed fluid into the pump comprising:

an input valve assembly;

a flow restrictor; and, a first time delay relay, wherein upon receiving a first signal from the air distribution system the first time delay relay transmits the first signal to the input valve assembly to cause a first volume of the compressed fluid to be supplied to the pump for a first amount of time, wherein the transmission of the first signal is at least partially caused by the reciprocal movement of the first and second diaphragms, wherein upon expiration of the first amount of time the input valve assembly causes a second volume of compressed fluid to be supplied to the pump, wherein the second volume of compressed fluid is less than the first volume of compressed fluid.

2. The pump of claim 1, further comprising:

a second time delay relay, wherein the movement of the first and second diaphragms in a first direction causes the air distribution system to transmit the first signal to the first time delay relay and the movement of the first and second diaphragms in a second direction causes the air distribution system to transmit a second signal to the second time delay relay, wherein upon receiving the second signal from the air distribution system the second time delay relay transmits the second signal to the input valve assembly to cause a third volume of the compressed fluid to be supplied to the pump for a second amount of time, wherein upon expiration of the second amount of time the input valve assembly causes a fourth volume of compressed fluid to be supplied to the pump, wherein the fourth volume of compressed fluid is less than the third volume of compressed fluid.

3. The pump of claim 2, wherein the first amount of time is substantially equal to the second amount of time, the first volume of compressed fluid is substantially equal to the third volume of compressed fluid; and, the second volume of compressed fluid is substantially equal to the fourth volume of compressed fluid.

4. The pump of claim 1, wherein the air logic controller is selectively attachable to the center section.

5. The pump of claim 1, wherein the first time delay relay comprises:

an adjustable time delay relay that allows for adjusting the first amount of time.

6. The pump of claim 1, wherein the flow restrictor is adjustable and allows for adjustment of the first or second volume of compressed fluid.

7. The pump of claim 1, further comprising:

a second time delay relay, wherein the first time delay relay at least partially controls the actuation of the input valve assembly to vary the supply of compressed air between the first volume and the second volume based at least partially on the movement of the first diaphragm assembly and the second time delay relay at least partially controls the actuation of the input valve assembly to vary the supply of compressed air between the first volume and the second volume based at least partially on the movement of the second diaphragm assembly.

8. The pump of claim 7, further comprising:

a logic or-element, wherein the logic or-element at least partially controls the transmission of the first signal and a second signal from the first and second time delay relays respectively for at least partially controlling the actuation of the input valve assembly.

9. A method comprising the steps of:

(a) operating an air operated double diaphragm pump, wherein operating the air operated double diaphragm pump initiates a first pumping stroke, the air operated double diaphragm pump comprising an air logic controller operatively connected to a center section of the pump for controlling the supply of the compressed fluid into the pump comprising:

an input valve assembly;

a flow restrictor; and, a first time delay relay;

(b) transmitting a first pneumatic signal to a first time delay relay, wherein the initiation of the first pumping stroke at least partially causes the transmission of the first pneumatic signal;

(c) transmitting the first pneumatic signal for a first amount of time, wherein receiving the first pneumatic signal at least partially causes the first time delay relay to transmit the first pneumatic signal to an input valve assembly for controlling the supply of compressed fluid to the air operated double diaphragm pump;

(d) supplying a first volume of compressed fluid to the air operated double diaphragm pump for the first amount of time; wherein the transmission of the first pneumatic signal to the input valve assembly at least partially causes the first volume of compressed fluid to be supplied to the air operated double diaphragm pump;

(e) supplying a second volume of compressed fluid to the air operated double diaphragm pump, wherein the second volume of compressed fluid is supplied to the air operated double diaphragm pump upon the expiration of the first amount of time and the second volume of compressed fluid is less than the first volume of compressed fluid; and, (f) initiating a second pumping stroke.

10. The method of claim 9, wherein step (e) further comprises the step of:

terminating the transmission of the first pneumatic signal to the input valve assembly upon expiration of the first amount of time.

11. The method of claim 9, wherein step (f) further comprises the steps of:

transmitting a second pneumatic signal to the first time delay relay, wherein the initiation of the second pumping stroke at least partially causes the transmission of the second pneumatic signal;

transmitting the second pneumatic signal for a second amount of time, wherein receiving the second pneumatic signal at least partially causes the first time delay relay to transmit the second pneumatic signal to the input valve assembly;

supplying a third volume of compressed fluid to the air operated double diaphragm pump for the second amount of time; wherein the transmission of the second pneumatic signal to the input valve assembly at least partially causes the third volume of compressed fluid to be supplied to the air operated double diaphragm pump;

supplying a fourth volume of compressed fluid to the air operated double diaphragm pump, wherein the fourth volume of compressed fluid is supplied to the air operated double diaphragm pump upon the expiration of the second amount of time and the fourth volume of compressed fluid is less than the third volume of compressed fluid; and, initiating a third pumping stroke.

12. The method of claim 11, wherein the third volume of compressed fluid is substantially equal to the first volume of compressed fluid and the fourth volume of compressed fluid is substantially equal to the second volume of compressed fluid.

13. The method of claim 11, wherein the step of supplying the fourth volume of compressed fluid to the air operated double diaphragm pump, wherein the fourth volume of compressed fluid is supplied to the air operated double diaphragm pump upon the expiration of the second amount of time and the fourth volume of compressed fluid is less than the third volume of compressed fluid, further comprises the step of:

terminating the transmission of the second pneumatic signal to the input valve assembly upon expiration of the second amount of time.

14. The method of claim 9, wherein step (f) further comprises the steps of:

transmitting a second pneumatic signal to a second time delay relay, wherein the initiation of the second pumping stroke at least partially causes the transmission of the second pneumatic signal;

transmitting the second pneumatic signal for a second amount of time, wherein receiving the second pneumatic signal at least partially causes the second time delay relay to transmit the second pneumatic signal to the input valve assembly;

supplying a third volume of compressed fluid to the air operated double diaphragm pump for the second amount of time; wherein the transmission of the second pneumatic signal to the input valve assembly at least partially causes the third volume of compressed fluid to be supplied to the air operated double diaphragm pump;

supplying a fourth volume of compressed fluid to the air operated double diaphragm pump, wherein the fourth volume of compressed fluid is supplied to the air operated double diaphragm pump upon the expiration of the second amount of time and the fourth volume of compressed fluid is less than the third volume of compressed fluid; and, initiating a third pumping stroke.

15. The method of claim 14, wherein the step of transmitting the second pneumatic signal for the second amount of time, wherein receiving the second pneumatic signal at least partially causes the second time delay relay to transmit the second pneumatic signal to the input valve assembly, further comprises the steps of:

preventing the transmission of the second pneumatic signal to the input valve assembly during the transmission of the first pneumatic signal; and, preventing the transmission of the first pneumatic signal to the input valve assembly during the transmission of the second pneumatic signal.

16. The method of claim 15, wherein a logic or-element prevents the transmission of the second pneumatic signal to the input valve assembly during the transmission of the first pneumatic signal and prevents the transmission of the first pneumatic signal to the input valve assembly during the transmission of the second pneumatic signal.

17. The method of claim 9, wherein step (f) further comprises the step of:

adjusting the first time delay relay, wherein the adjustment of the first time delay relay causes a corresponding adjustment to the first amount of time.

* * * * *